US008640366B1

(12) United States Patent
Solberg

(10) Patent No.: US 8,640,366 B1
(45) Date of Patent: Feb. 4, 2014

(54) MILITARY AWARD ATTACHMENT METHOD AND DEVICE

(71) Applicant: Friend V. Solberg, Belton, TX (US)

(72) Inventor: Friend V. Solberg, Belton, TX (US)

(73) Assignee: Friend Solberg, Belton, TX (US)

( * ) Notice: Subject to any disclaimer, the term of this patent is extended or adjusted under 35 U.S.C. 154(b) by 0 days.

(21) Appl. No.: 13/842,313

(22) Filed: Mar. 15, 2013

(51) Int. Cl.
*A44C 3/00* (2006.01)

(52) U.S. Cl.
USPC ..... 40/1.5; 33/653

(58) Field of Classification Search
USPC ..... 40/1.5; 33/653
See application file for complete search history.

(56) References Cited

U.S. PATENT DOCUMENTS 1,245,615 A * 11/1917 Pickering ..... 40/1.5
1,377,676 A * 5/1921 Gaunt ..... 40/1.5
5,564,166 A * 10/1996 Roy ..... 24/3.11
5,782,022 A * 7/1998 Tubberville ..... 40/1.6
6,766,603 B1 * 7/2004 Perrone ..... 40/1.6
7,010,875 B1 * 3/2006 Perrone ..... 40/1.5
7,181,879 B1 * 2/2007 Key ..... 40/661
7,877,907 B1 * 2/2011 Hudick ..... 40/1.5
2007/0294924 A1 * 12/2007 Schriver ..... 40/1.5
2009/0307917 A1 * 12/2009 Allen ..... 33/653

* cited by examiner

*Primary Examiner* — Gary Hoge
(74) *Attorney, Agent, or Firm* — Schwegman, Lundberg & Woessner, P.A.

(57) ABSTRACT

A method for attaching a military award to a uniform comprises connecting a suspension member attached to the military award to the uniform beneath a collar flap of the uniform, so that the military award hangs from the collar in a position that coincides with its conventional semi-permanent attachment position in which the award is laterally offset on a chest area of the uniform. Temporary connection of the suspension member to the collar flap comprises cooperating hook-and-loop connectors mounted respectively to an underside of the collar flap and the suspension member.

14 Claims, 5 Drawing Sheets

MILITARY AWARD ATTACHMENT METHOD AND DEVICE

TECHNICAL FIELD

The present application relates generally to military awards, and to methods of attaching military awards to uniforms, for example at award presentation events or ceremonies.

BACKGROUND

Military awards are often designed for attachment to the uniform of a recipient by pinning the award to the uniform in a designated zone of the uniform, typically over the left chest area, where military awards are to be carried and displayed.

Some award ceremonies may, however, have a large number of recipients, so that considerable time can be consumed in pinning the respective medals to the uniforms of their recipients.

BRIEF DESCRIPTION OF THE DRAWINGS

Some embodiments are illustrated by way of example and not limitation in the figures of the accompanying drawings, in which.

DETAILED DESCRIPTION

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

Example embodiments of the disclosure include a military award attachment method that comprises connecting a suspension member (e.g., a strip material) to a collar of the uniform directly above the uniform's designated award display zone, so that the award hangs by the suspension member from the collar, and is positioned in the designated display zone. In some examples, a connection point between the suspension member and the uniform is beneath the collar flap, thus being obscured from view. A readily releasable connection, such as a Velcro-type connection, is employed in some examples to expedite award attachment. Because the connection is, however, hidden from view, the temporary nature of such an attachment method does not detract from the appearance and prestige of the award and its presentation.

These and other aspects of the disclosure will be evident from the following description of a more specific example embodiment.

Figure 1:
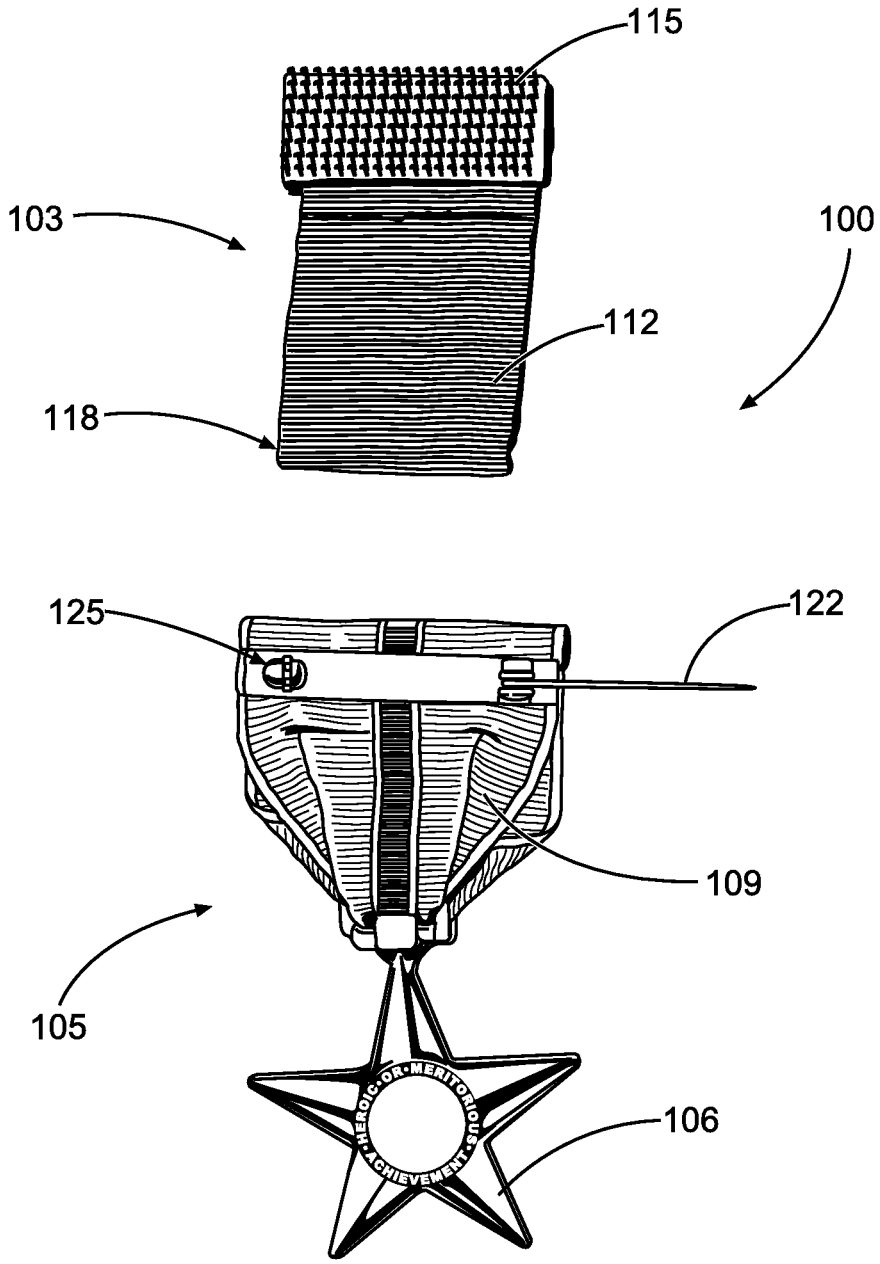
FIG. 1 depicts a schematic rear view of a military award kit in accordance with an example embodiment.

FIG. 1 is a schematic view of an example kit 100 for attaching military awards or decorations to military uniforms, e.g., during military award ceremonies. The example kit 100 comprises a military award 105 and a mounting device 103. The mounting device 103 is removably connectable to the military award 105 for temporary mounting of the military award 105 on a military uniform 505 (see FIG. 5), e.g., during an awards ceremony.

In this example embodiment, the military award 105 comprises a pendant element in the form of a medal 106 attached to a military award ribbon 109. Note that the example medal-ribbon combination (excluding the mounting device 103) is a conventional configuration, being intended for mounting on the uniform by pinning the ribbon 109 to the chest of the uniform. The ribbon 109 therefore has a conventional mounting element in the form of a pin 122 and co-operating latch mechanism 125 adjacent an operatively upper end of the ribbon 109, furthest from the medal 106.

The mounting device 103 in this example comprises a suspension member in the example form of a suspension strip 112 formed from an elongated strip of material folded back upon itself and fastened together to form a loop 118 at its operatively lower end. The loop 118 provides a connection formation for end-to-end connection of the suspension strip 112 to the ribbon 109.

The opposite, operatively upper end of the mounting device 103 has connector for attaching the suspension strip 112 to the uniform 505 by engagement with the uniform 505 at or adjacent a collar flap of the uniform 505, as will be described in greater detail below. The mounting element may be a hook-and-loop connector (e.g., a strip of hook-and-loop material) for attachment to a complementary hook-and-loop base member forming part of the uniform. In this example embodiment, the mounting element is a Velcro patch 115 sown to the upper end of the suspension strip 112.

Figure 2:
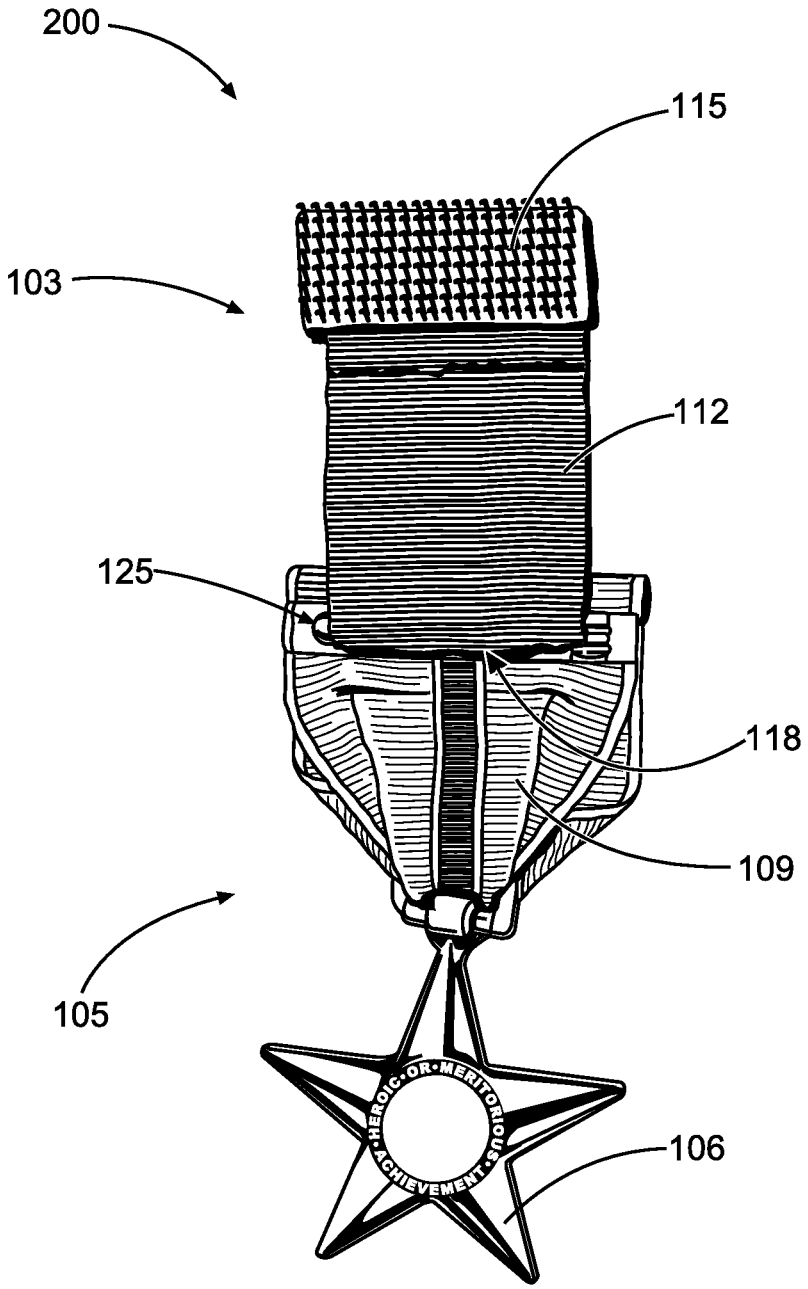
FIG. 2 depicts a schematic rear view of a military award assembly, in accordance with an example embodiment.
Figure 3:
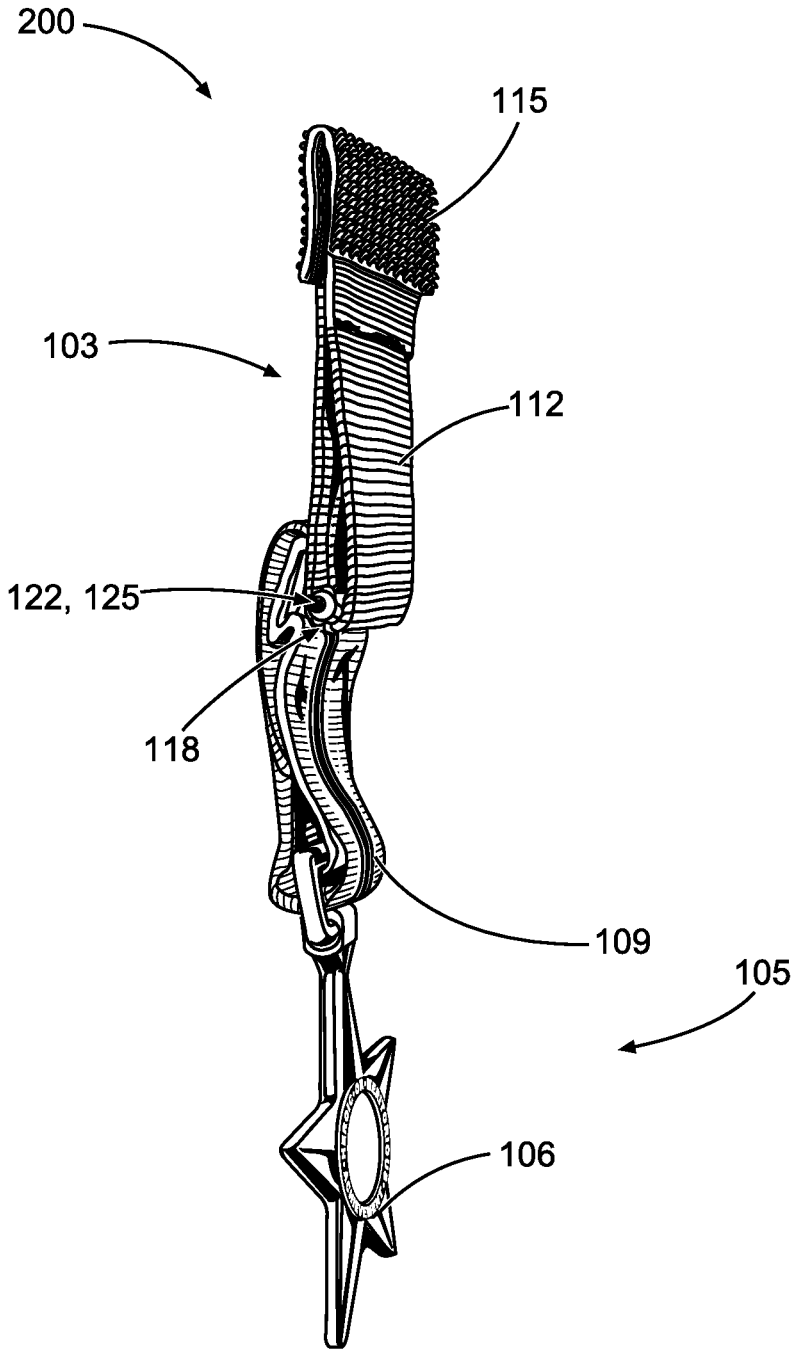
FIG. 3 depicts a schematic side view of the example military award assembly of FIG. 1.

FIG. 2 shows the kit 100 in an assembled condition, in which the mounting device 103 is attached to the ribbon 109 to form a military award assembly 200. In this example embodiment, the mounting device 103 is attached to the ribbon 109 by passing the pin 122 through the loop 118, transversely to a lengthwise direction of the suspension strip 112, and engaging the pin 122 with the latch 125. When thus attached, suspension of the ribbon-medal combination 105 by means of the mounting device 103 automatically causes substantially coplanar end-to-end alignment of the ribbon 109 and the suspension strip 112. This alignment, as well as reception of the pin 122 in the loop 118, can also be seen in FIG. 3.

Figure 4:
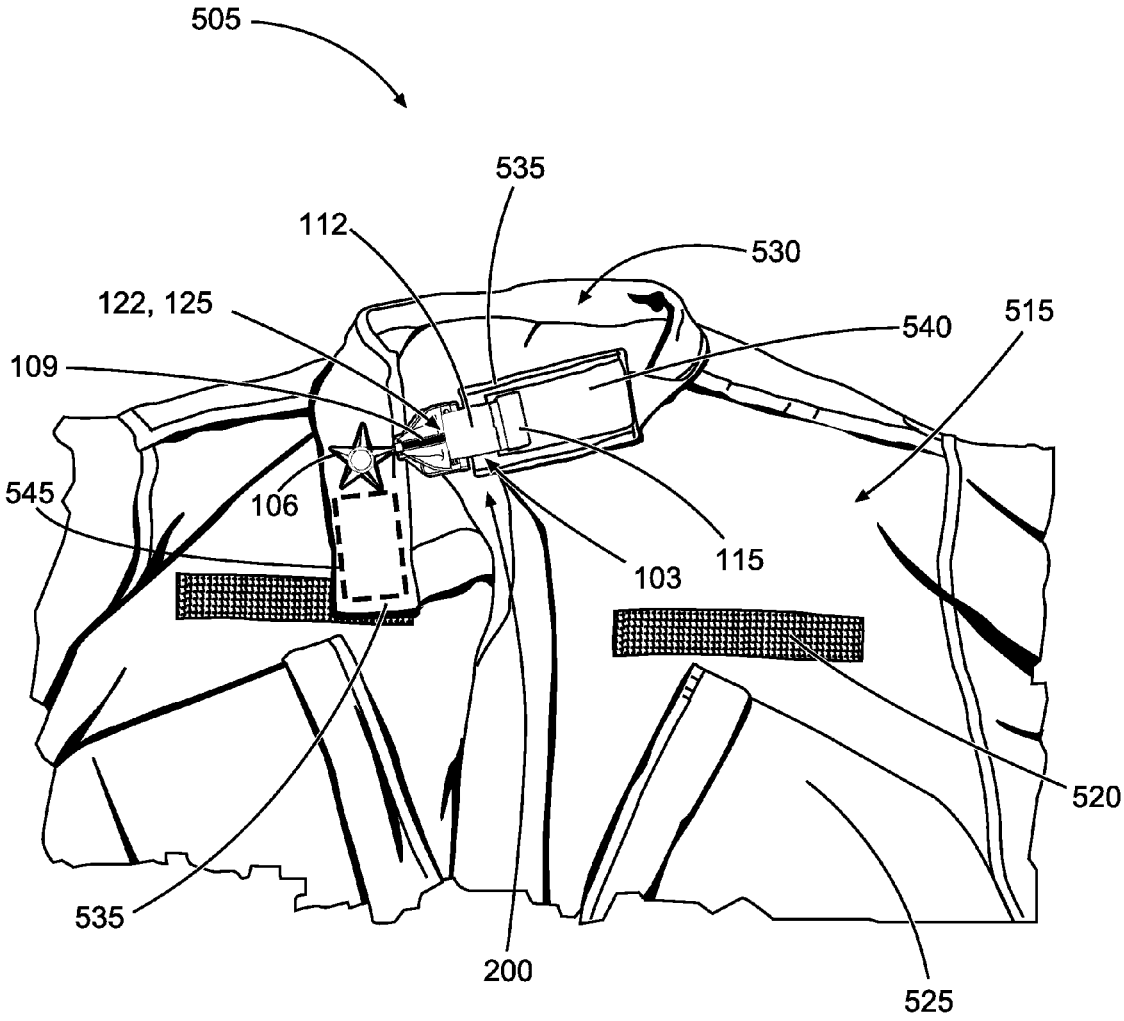
FIG. 4 depicts a schematic front view of a military uniform to which a military award assembly in accordance with an example embodiment of FIG. 2 is attached, a collar of the uniform being turned up to illustrate attachment of the military award assembly to an underside of the collar.
Figure 5:
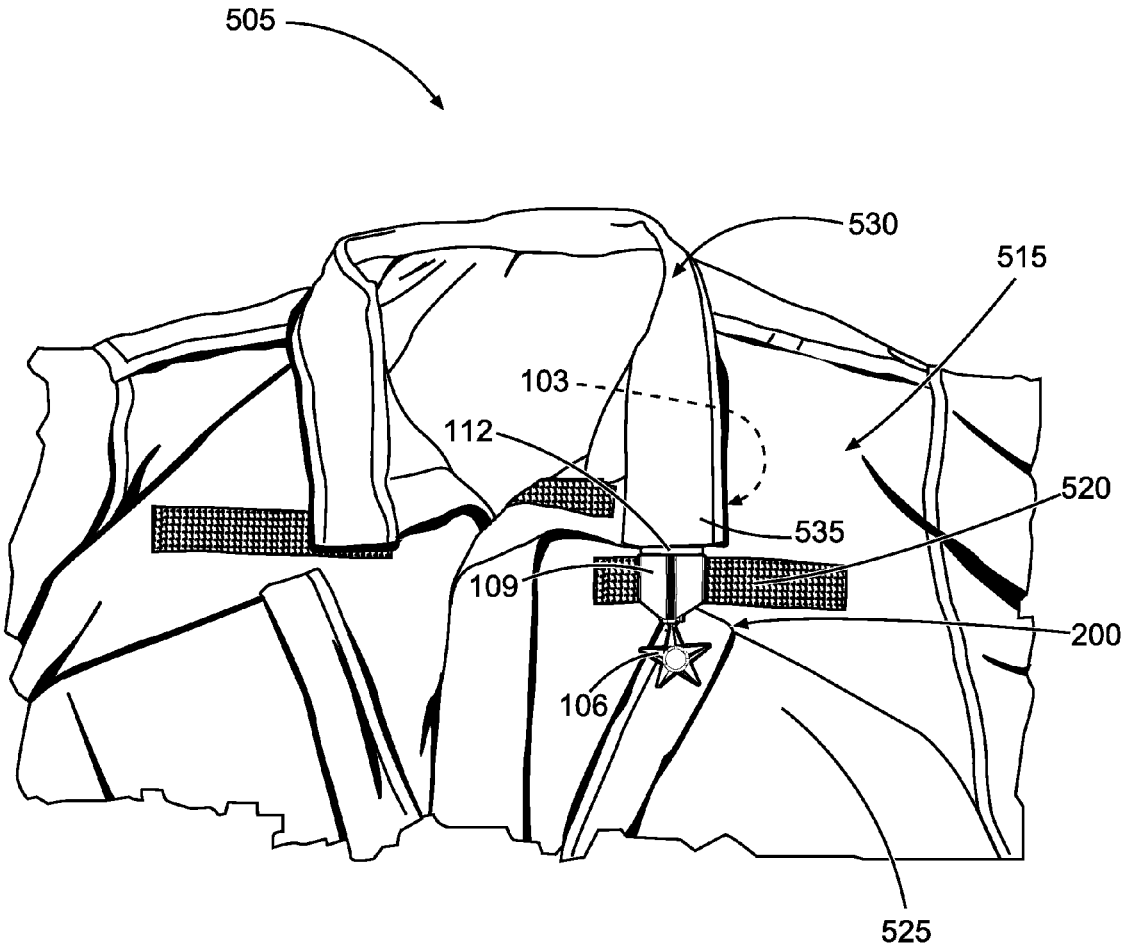
FIG. 5 depicts a schematic front view of a military uniform having mounted thereon a military award by means of a mounting device in accordance with an example embodiment, e.g. during an award presentation event.

FIG. 5 shows a standard issue Army Combat Uniform (ACU) 505 of the United States Armed Forces. The uniform 505 includes a convertible collar 530 having a pair of flaps that can be worn either in a conventional configuration (FIG. 5), in which the flaps 535 lie flat against the front of the uniform 505, or as a mandarin collar, in which the flaps 535 are turned up and are connected together at the front, fitting tightly around the neck. The ACU 505 has complementary hook-and-loop fasteners in the form of strips of Velcro sown to the undersides of the respective collar flaps 535. A collar backing 540 that provides the collar fastener on a left collar flap 535 can be seen in FIG. 4, where the left collar flap 535 is turned up for the purpose of illustration.

In this example embodiment, the collar backing 540 on the left flap 535 serves as a base member or connector to which the Velcro connector patch 115 of the mounting device 103 is releasably connectable by hook-and-loop engagement. The Velcro patch 115 of the mounting device 103 is selected to be complementary to the collar backing 540.

Military awards of the type illustrated in this example embodiment (being a ribbon/metal combination with a pin and latch mechanism) are conventionally designated and configured for semipermanent attachment to the cloth of the uniform 505 in an area directly above a horizontally extending name tape backing strip 520 on a left chest area 515 of the uniform 505. The designated attachment zone for the military award 105 is, in this example, specified as a ¼ inch wide horizontal strip over the name tape backing strip 520. Conventional semipermanent attachment by means of the pin 122 and latch 125 therefore comprises pinning the ribbon 109 to the uniform 505 adjacent the upper edge of the name tape backing strip 520, with the ribbon 109 and medal 106 hanging down therefrom so that the medal 106 is positioned in a designated award display zone below the name tape backing strip 520, laterally offset on the left chest area 515, the medal 106 being positioned over the soldier's heart.

When the military award 105 is temporarily attached by the mounting device 103 to the collar flap 535, with the collar 530 turned down (FIG. 5), the military award 105 hangs by the suspension strip 112 from the collar flap 535 so that the medal 106 hangs over the soldier's heart, in the designated award display zone on the left chest area of the uniform 505. As can be seen in FIG. 5, the length of the suspension strip 112 is in this example selected so that the pin 122 and latch 125 on the ribbon 109 are vertically in register with the conventionally designated attachment area above the name tape backing strip 520.

It can thus be seen that the position of the military award 105 on the uniform 505 when temporarily attached to the collar 530 by the mounting device 103 is substantially identical to its position when attached to the uniform in conventional fashion by its native semipermanent attachment mechanism (e.g., the pin 122 and latch 125).

In operation, the mounting device 103 can be used at formal events, e.g., during military award presentation events or ceremonies, where recipients are presented with respective military awards, each recipient's award being individually attached to their uniform 505. The mounting device 103 provides a method of attaching the military award 105 to the uniform 505 that requires little manual dexterity and is considerably less time-consuming than the conventional method of pinning the medal 106 to the uniform 505, requiring perforation of the uniform cloth.

The kit 100 is assembled prior to an award ceremony, e.g. by passing the pin 122 through the loop 118 and engaging it with the latch 125. A presiding officer tasked with presenting the military awards 105 is provided with the preassembled kit 100 during the ceremony. The presiding officer may then attach the military award 105 to uniform 505 by slipping the Velcro connector 115 of the mounting device 103 under the left collar flap 535, and pressing together the flap 535 and the Velcro connector 115 between thumb and finger, to connect together the Velcro connector 115 and the Velcro backing strip 520. Note, again, that the position of the collar flap 535 as shown in FIG. 4 is for illustration purposes only, and that the collar flap 535 is typically not turned up in order to allow connection to the mounting device 103.

When attached to the uniform 505 in this manner, the Velcro connection between the mounting device 103 and the uniform 505 is hidden from view, being obscured by the flap 535. Use of the mounting device 103 thus permits fast and easy attachment of the military award 105, without detracting from the appearance of the decorated uniform 505, or cheapening the appearance of the award presentation event.

As can be seen with reference to FIG. 5, the awarded medal 106, suspended from the collar 530, is substantially similar in appearance to that of a medal pinned to the uniform in conventional fashion. This illusion is facilitated by selecting the color and/or pattern and/or texture of the suspension strip 112 to correspond to that of the uniform 505, so that any part of the suspension strip 112 that is visible is unobtrusive and effectively disguised.

Note that differently colored suspension strips 112 may be used for attachment of medals to differently colored uniforms, the suspension strip 112 typically having a color similar to that of the corresponding uniform immediately below its collar flaps.

The length of the suspension strip 112 may likewise be customized for different uniforms, to account for differences in distance from the collar to the name tape backing strip 520 or corresponding designated award display zone.

In other embodiments, the ribbon 109 may be connected to the collar flap 535 by other connection methods that are more convenient than pinning the medal to the uniform. The suspension strip 112 may, for example, be provided with a clip that has pivotally connected jaws, so that the military award can be attached to the uniform 505 by clipping the ribbon to the collar 530. Complementary magnetic connectors may likewise be provided on the suspension strip 112 and the collar flap 535 respectively, for magnetic attachment.

It is a benefit of the example mounting device 103 and the disclosed method of attaching military awards to uniforms that it greatly expedites presentation of awards to recipients during formal presentation events, while preserving the ceremony's traditional aesthetics.

Thus, it can be seen that aspects disclosed by the described example embodiment include a method for attaching a military award to a uniform, the method comprising connecting a suspension member attached to the military award to the uniform at or adjacent one of a pair of collar flaps of the uniform, suspending the military award from the suspension member such that the position of the suspended military award coincides with a designated display zone for the military award on a lateral chest area of the uniform.

At least some of the benefits of the disclosed embodiments may be achieved by attaching the suspension strip to the collar by a means other than hook-and-loop fastening, and/or by providing for attachment of the suspension member to the uniform beneath the collar flap, without directly attaching it to the collar flap.

As described, the method may however compromise attaching a connector fastened to the suspension member to a complementary connector located beneath the particular collar flap, so that collar flap obscures the connector from view.

In the described example embodiment, the connector of the suspension member is a Velcro connector that provides a hook-and-loop fastener, for attachment to a complementary hook-and-loop fastening member on an underside the collar flap.

The method may, in use, comprise, in advance of an award presentation event, attaching a mounting device comprising the suspension member to each of a plurality of military awards, to form multiple award assemblies. In such case, a presiding officer may, at the award presentation event, be provided with respective award assemblies for attaching the respective military awards to corresponding recipients by use of the mounting device.

Although the present invention has been described with reference to specific example embodiments, it will be evident that various modifications and changes may be made to these embodiments without departing from the broader spirit and scope of method and/or system. Accordingly, the specification and drawings are to be regarded in an illustrative rather than a restrictive sense.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A method for attaching a military award to a uniform, the method comprising connecting a suspension member attached to the military award to the uniform at or adjacent one of a pair of collar flaps of the uniform, suspending the military award from the suspension member such that the position of the suspended military award has a laterally offset position on a chest area of the uniform.

2. The method of claim 1, wherein connecting the suspension member to the uniform comprises connecting the suspension member to a particular one of the collar flaps.

3. The method of claim 2, wherein connecting the suspension member to the uniform comprises attaching a connector fastened to the suspension member to a complementary connector located beneath the particular collar flap, so that collar flap obscures the connector from view.

4. The method of claim 3, wherein the connector of the suspension member comprises a hook-and-loop fastener, and wherein connecting of the suspension member to the uniform comprises attaching the hook-and-loop fastener to a complementary hook-and-loop fastening member attached to an underside of the collar flap.

5. The method of claim 3, wherein the suspension member is a strip of material that is attached at an operatively lower end thereof to a ribbon forming part of the military award, the suspension member being dimensioned such that attachment of the suspension member to the collar brings an operatively upper end of the ribbon coincides with a designated attachment zone for the military award adjacent a name tape strip of the uniform.

6. The method of claim 5, wherein the suspension strip is of a color that corresponds to the color of the uniform between the particular collar and the designated award display zone.

7. The method of claim 5, further comprising attaching the suspension member to the ribbon by receiving a pin mounted on the ribbon in a loop at the operatively lower end of the suspension member, and latching the pin to a cooperating latch mechanism mounted on the ribbon.

8. The method of claim 1, further comprising;

in advance of an award presentation event, attaching a mounting device comprising the suspension member to each of a plurality of military awards, to form multiple award assemblies; and at the award presentation event, providing respective award assemblies to an awarding officer for attaching the respective military awards to corresponding recipients by use of the mounting device.

9. An assembly comprising:

a military award that includes a pendant element that is to be displayed in a designated display zone on a lateral chest area of a uniform; and a mounting device comprising a connector for attachment to the uniform or adjacent to a flap of a collar of the uniform, and a suspension member attached to the connector and to the military award, extending between the connector and the military award, the suspension member being dimensioned to bring the pendant element in register with the display zone of the uniform responsive to suspension of the military award from the uniform by attachment of the connector to the uniform at or adjacent to the collar flap.

10. The assembly of claim 9, wherein the connector is configured for attaching the suspension member to the collar flap.

11. The assembly of claim 9, wherein the connector of the suspension member comprises a hook-and-loop fastener for engagement by a complementary hook-and-loop fastening member attached to an underside of the collar flap.

12. The assembly of claim 9, wherein the military award further comprises an elongate ribbon that is connected at its operatively upper end to the suspension member, and is connected at its operatively lower end to the pendant element.

13. The assembly of claim 12, wherein the connection between the ribbon and the suspension member is readily releasable.

14. A kit comprising:

a military award that includes a pendant element for display in a designated display zone on a lateral chest area of a uniform; and a mounting device comprising a connector for attachment to the uniform or adjacent to a flap of a collar of the uniform, and a suspension member attached to the connector, the suspension member being releasably connectable to the military award to extend between the connector and the military award, the suspension member being dimensioned to bring the pendant element in register with the display zone of the uniform responsive to attachment of the connector to the uniform at or adjacent to the collar flap.

* * * * *